US011594840B2

(12) United States Patent
Yagi et al.

(10) Patent No.: US 11,594,840 B2
(45) Date of Patent: Feb. 28, 2023

(54) RESIN MOLDED PRODUCT

(71) Applicant: Yazaki Corporation, Tokyo (JP)

(72) Inventors: Arata Yagi, Makinohara (JP); Isanori Shimizu, Makinohara (JP); Masataka Nagayama, Makinohara (JP); Shinji Ohtsuka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/333,998

(22) Filed: May 28, 2021

(65) Prior Publication Data

US 2021/0376526 A1 Dec. 2, 2021

(30) Foreign Application Priority Data

May 29, 2020 (JP) ..... JP2020-094301

(51) Int. Cl.
*H01R 13/631* (2006.01)
*H01R 13/405* (2006.01)

(52) U.S. Cl.
CPC ..... *H01R 13/631* (2013.01); *H01R 13/405* (2013.01)

(58) Field of Classification Search
CPC .... H01R 13/631; H01R 13/405; H01R 43/18; H01R 13/629; H01R 13/502; H01R 12/716; H01R 13/02; H01R 2201/26
See application file for complete search history.

(56) References Cited

U.S. PATENT DOCUMENTS

| | | | | |
|---|---|---|---|---|
| 7,929,901 | B2 * | 4/2011 | Yasuhara | G03G 15/6505 16/422 |
| 10,293,574 | B2 * | 5/2019 | Samejima | H05K 5/003 |
| 2006/0166559 | A1 * | 7/2006 | Nakai | G06K 19/07741 439/630 |
| 2013/0033098 | A1 * | 2/2013 | Nagashima | B60T 7/042 361/752 |
| 2015/0156929 | A1 | 6/2015 | Nagashima et al. | |
| 2018/0072016 | A1 * | 3/2018 | Samejima | H05K 5/0034 |
| 2021/0376526 | A1 * | 12/2021 | Yagi | H01R 43/18 |

FOREIGN PATENT DOCUMENTS

| | | |
|---|---|---|
| JP | 2013-35319 A | 2/2013 |
| JP | 2018-45915 A | 3/2018 |

* cited by examiner

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A resin molded product includes a plate portion having a plate-like shape and having assembly locations in which a mating member is assembled on both surfaces of the plate portion in a plate thickness direction, a reference portion provided on one surface of the plate portion and used for alignment with the mating member, and a through hole which penetrates the reference portion in the plate thickness direction and opens on the both surfaces of the plate portion. The reference portion has a columnar shape extending in the plate thickness direction, and the through hole opens at an extending end of the reference portion and extends in the plate thickness direction to open on the other surface of the plate portion. The plate portion further includes a terminal provided so as to extend in the plate thickness direction at the assembly location on the other surface.

3 Claims, 6 Drawing Sheets

RESIN MOLDED PRODUCT

CROSS-REFERENCE TO RELATED APPLICATIONS

This application is based on and claims priority under 35 USC 119 from Japanese Patent Application No. 2020-094301 filed on May 29, 2020, the contents of which are incorporated herein by reference.

TECHNICAL FIELD

The present invention relates to a resin molded product.

BACKGROUND ART

In a recent year, a resin molded product used as various components mounted on a vehicle and the like has been proposed. For example, one of the resin molded product of the related art has a plate portion having a plate-like shape and includes a connector portion (assembly location) in which a mating connector (mating member) is assembled to one surface of the plate portion and which holds a terminal and an equipment accommodating portion and a substrate accommodating portion (assembly location) where equipment and a circuit board (mating member) are respectively assembled on one surface and the other surface of the plate portion (see, for example, Patent Literature 1). This resin molded product of the related art is used as a component of an ABS unit for a vehicle.

CITATION LIST

Patent Literature

Patent Literature 1: JP-A-2018-045915

In this type of the resin molded product, a reference portion (typically, a protruding boss portion) used for alignment with a mating member is provided on one surface of the plate portion and this reference portion may be used as a reference in a dimensional inspection of the resin molded product.

In this case, for example, as a dimensional inspection, when a relative position from the reference portion of the assembly location (for example, the terminal of the connector portion protruding from the plate portion to one side) provided on one surface of the plate portion in the same manner as the reference portion is measured, the reference portion and the assembly location exist on the same surface of the plate portion and both can be visually recognized at the same time, and thus the relative position of the assembly location can be easily measured.

On the other hand, as a dimensional inspection, when the relative position from the reference portion of the assembly location (for example, the terminal of the connector portion protruding from the plate portion to the other side) provided on the other surface of the plate portion as opposed to the reference portion is measured, the reference portion and the assembly location are located on different surfaces of the plate portion, so the relative position of the assembly location cannot be easily measured. As an example, in this case, by setting a portion (for example, a periphery of the plate portion) which is visible from both one side and the other side of the plate portion in the resin molded product as a relay point and adding up a relative position between the reference portion and the relay point and a relative position between the relay point and the assembly location, the relative position between the reference portion and the assembly location can be measured. However, when such a measurement method is used, a measurement error increases by the amount of intervention of the relay point, and thus the man-hours required for the measurement also increase.

SUMMARY OF INVENTION

One of objects of the present invention is to provide a resin molded product which can improve the accuracy of dimensional inspection and reduce the man-hours required for dimensional measurement.

The resin molded product according to the present invention includes a plate portion having a plate-like shape and having assembly locations in which a mating member is assembled on both surfaces of the plate portion in a plate thickness direction, a reference portion provided on one surface of the plate portion and used for alignment with the mating member, and a through hole which penetrates the reference portion in the plate thickness direction and opens on the both surfaces of the plate portion.

DESCRIPTION OF EMBODIMENT

Embodiment

Figure 1:
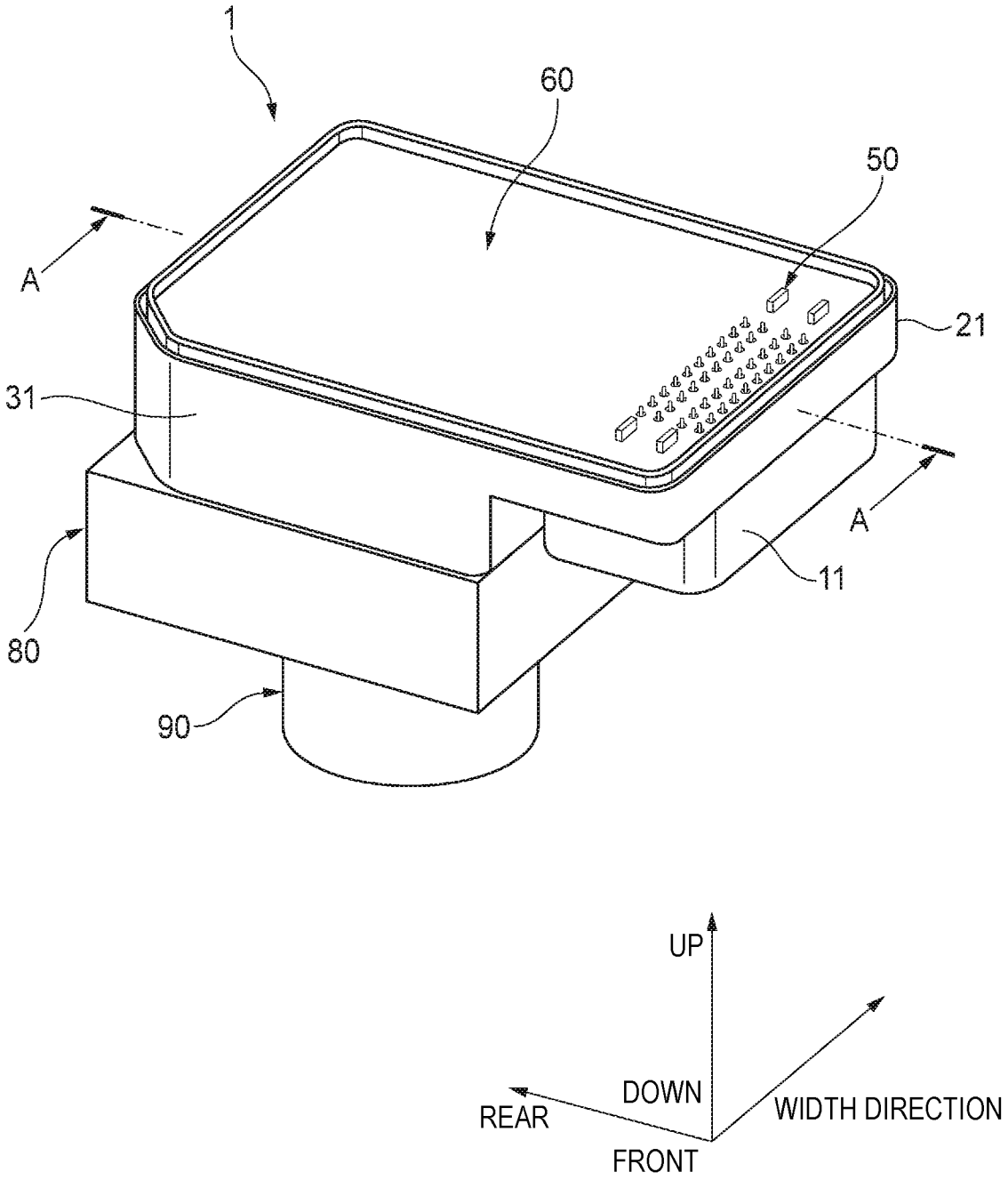
FIG. 1 is a perspective view of a resin molded product according to an embodiment of the invention in which a circuit board and equipment are assembled.

Hereinafter, a resin molded product 1 according to an embodiment of the present invention will be described with reference to the drawings.

As illustrated in FIGS. 1 to 4 (particularly, FIGS. 2 to 3), the resin molded product 1 is a resin molded product integrally including a connector portion 10, a substrate accommodating portion 20, and an equipment accommodating portion 30. In this example, the resin molded product 1 is used as a part of an Antilock Brake System (ABS) unit for a vehicle. As will be described below, the substrate accommodating portion 20 accommodates a circuit board 60 for ABS control and the equipment accommodating portion 30 accommodates a solenoid coil 71 forming a hydraulic valve 70. Hereinafter, for convenience of explanation, as illustrated in FIGS. 1 to 6, an up-down direction, a width direction, a front-rear direction, the top, the bottom, the front and the rear are defined. The up-down direction, the width direction, and the front-rear direction are orthogonal to each other. Also, in FIGS. 4 to 6, for convenience of explanation, a recess 13 and a terminal insertion hole 33, which will be described below, are omitted.

Figure 3:
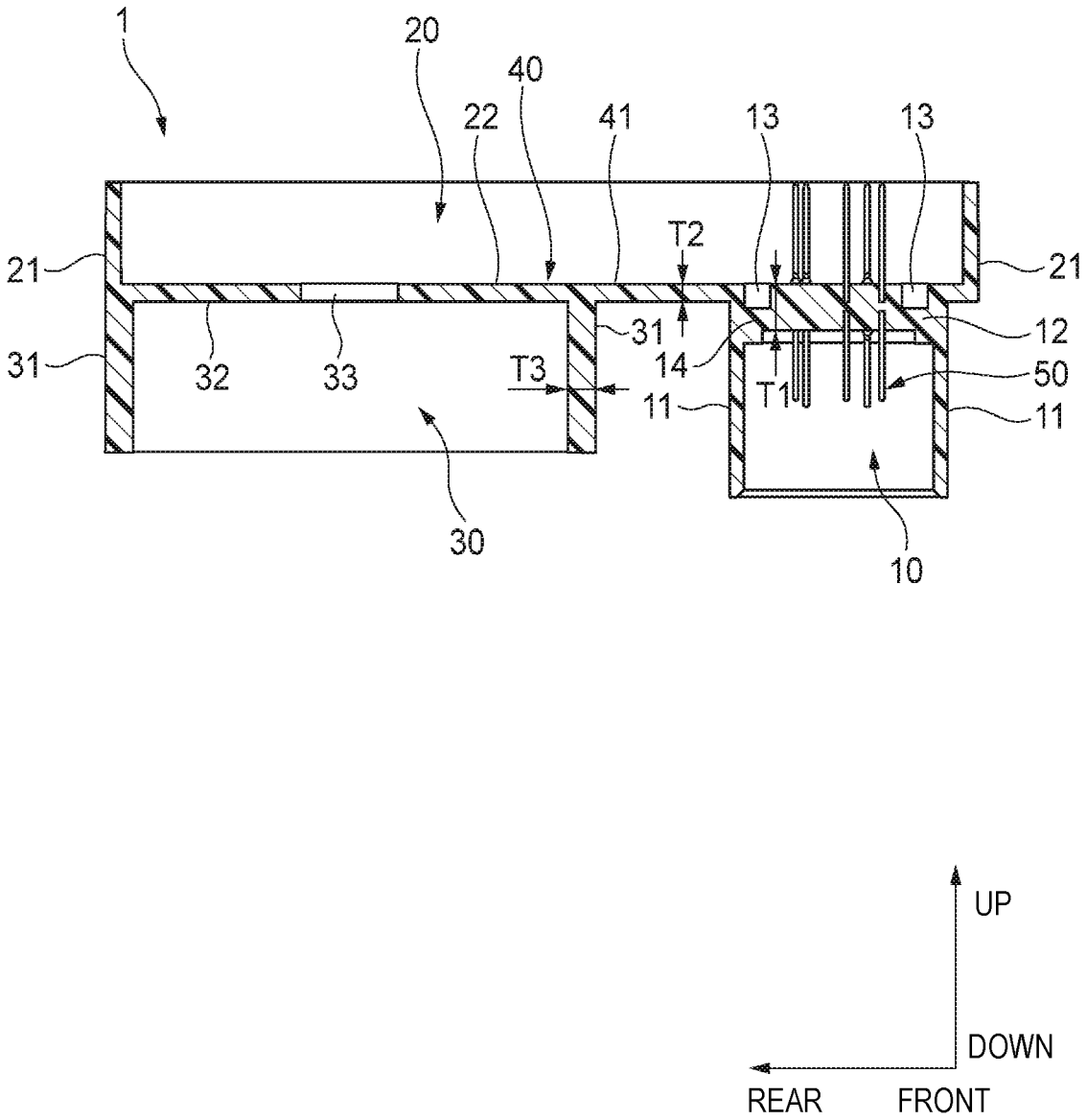
FIG. 3 is a cross-sectional view corresponding to FIG. 2 of the resin molded product illustrated in FIG. 1 in a single state.

As illustrated in FIG. 3, the resin molded product 1 includes a flat plate-shaped base plate 40 located at a substantially central portion in the up-down direction of the resin molded product 1. On a lower surface of a front side portion of the base plate 40, a substantially rectangular tubular frame body protruding downward is provided as a side wall 11 of the connector portion 10 (see also FIG. 4). An area of the base plate 40 surrounded by the side wall 11 forms an inner wall 12 of the connector portion 10.

Figure 4:
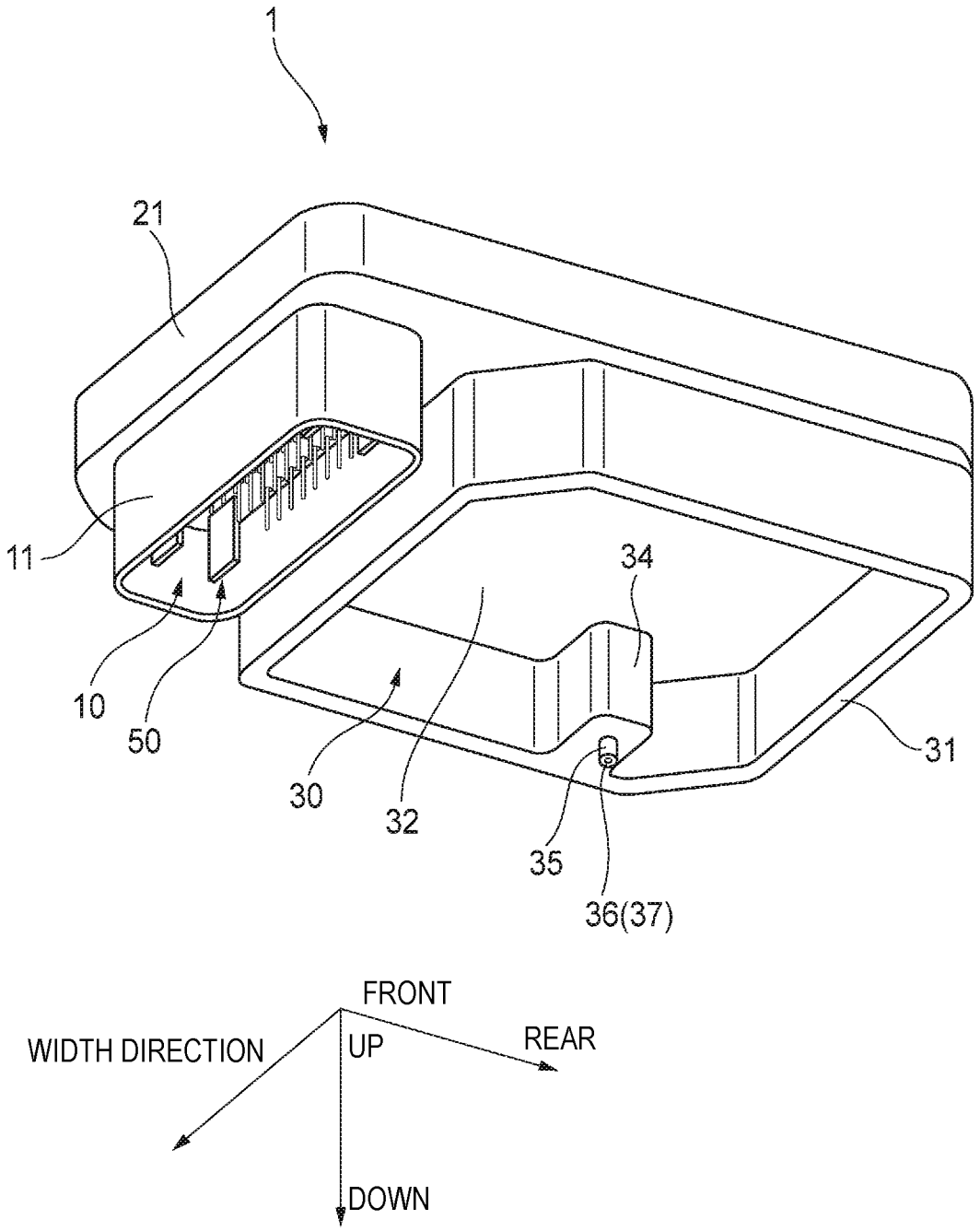
FIG. 4 is a perspective view of the resin molded product illustrated in FIG. 1 in a single state as viewed from below.

A tubular frame body is provided on an upper surface of a peripheral edge of the base plate 40 as a side wall 21 of the substrate accommodating portion 20 (see also FIG. 4). In other words, the base plate 40 also serves as an inner wall 22 of the substrate accommodating portion 20.

On a lower surface of a rear side portion of the base plate 40, a substantially rectangular tubular frame body protruding downward is provided as a side wall 31 of the equipment accommodating portion 30 so as to be arranged at intervals on a rear side of the side wall 11 (see also FIG. 4). An area of the base plate 40 surrounded by the side wall 31 forms an inner wall 32 of the equipment accommodating portion 30.

On the inner wall 12 of the connector portion 10, a large number of terminals 50 extending linearly in the up-down direction (in other words, a mating direction) are press-fitted and fixed so as to penetrate each of a large number of through holes (not illustrated) provided in the inner wall 12 which penetrate in the up-down direction. That is, an upper end portion of each terminal 50 is exposed to the substrate accommodating portion 20 and a lower end portion thereof is exposed to the connector portion 10.

A thickness T1 of a portion of the base plate 40 corresponding to the inner wall 12 is larger than a thickness T2 of the other portion of the base plate 40. That is, the thickness T1 of the inner wall 12 of the connector portion 10 is larger than the thickness T2 of the inner wall 32 of the equipment accommodating portion 30 and the thickness T2 of a connecting portion 41 connecting the inner wall 12 and the inner wall 32 of the equipment accommodating portion 30.

On an upper surface of the inner wall 12 of the connector portion 10, an annular recess 13 recessed downward is formed at a position slightly inside the tubular side wall 11 and at a position avoiding the terminal 50. In other words, the recess 13 is formed so as to be recessed in a thickness direction of the inner wall 12 on a back surface (upper surface of FIG. 3) of an inner surface (surface defining a fitting chamber) of the connector portion 10 (fitting chamber) defined by the side wall 11 and the inner wall 12. Due to the recess 13, a thin portion 14 of the inner wall 12 is formed near a connection position between the inner wall 12 and the connecting portion 41 and at the position avoiding the terminal 50.

The "near" may be a position where the support of the terminal 50 is not affected or the influence thereof is minimal and the distortion of the resin molded product 1 due to a difference in cooling time described below can be suppressed. For example, the "near" can be rephrased as a position between a connection position between the inner wall 12 and the connecting portion 41 and a region of the inner wall 12 through which the terminal 50 penetrates.

Terminal insertion holes 33 (through holes) for inserting a pair of leaf spring-shaped terminals 73 (see FIG. 2) protruding upward from an upper part of the solenoid coil 71 are respectively formed at a plurality of locations on the inner wall 32 of the equipment accommodating portion 30. A thickness T3 of the side wall 31 of the equipment accommodating portion 30 is slightly larger than the thickness T2 of the connecting portion 41 in this example, but may be the same as the thickness T2 of the connecting portion 41.

When a mating connector (not illustrated) is fitted into the connector portion 10 (specifically, the fitting chamber defined by the side wall 11 and the inner wall 12), a terminal (female terminal, not illustrated) provided on the mating connector and the terminal 50 will be electrically connected.

Figure 2:
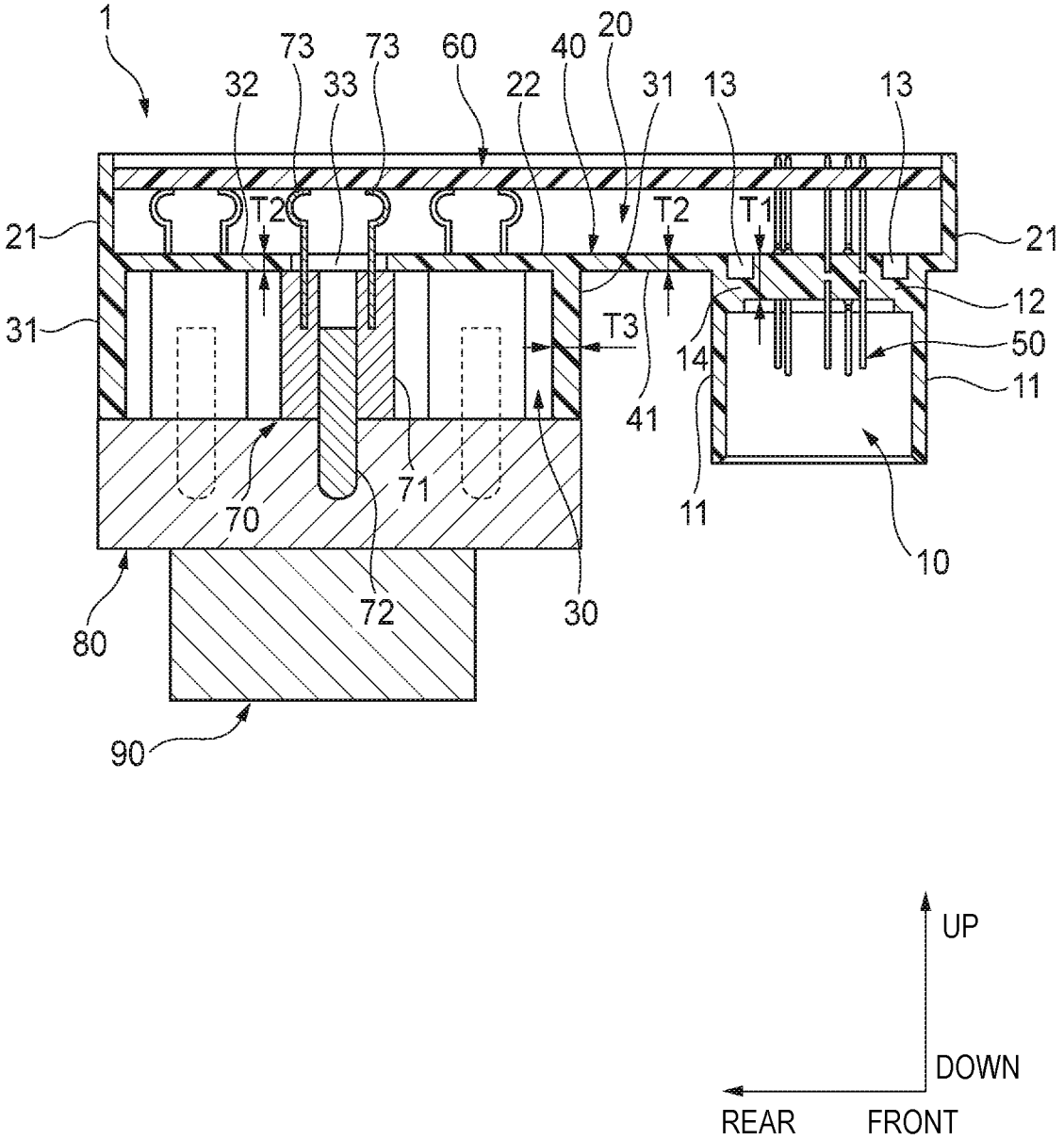
FIG. 2 is a cross-sectional view taken along the line A-A of FIG. 1.

As illustrated in FIGS. 1 and 2, the circuit board 60 for ABS control is accommodated and fixed in the substrate accommodating portion 20. When the circuit board 60 is fixed, upper end portions of a large number of terminals 50 are fixed to the circuit board 60 in a state of penetrating each of a large number of through holes (not illustrated) penetrating in the up-down direction and provided in the circuit board 60. As a result, each terminal 50 and the circuit board 60 are electrically connected.

A plurality of solenoid coils 71 are accommodated and fixed in the equipment accommodating portion 30 so that the leaf spring-shaped terminal 73 protruding upward from the solenoid coil 71 passes through the terminal insertion hole 33 and is exposed to the substrate accommodating portion 20.

An upper end of each leaf spring-shaped terminal 73 exposed on the substrate accommodating portion 20 is in press-contact with the lower surface of the circuit board 60. As a result, each solenoid coil 71 is electrically connected to the mating connector mounted on the connector portion 10 via the circuit board 60.

The solenoid coil 71 has a cylindrical shape and a rod-shaped plunger 72 is accommodated in an internal space so as to be movable in the up-down direction relative to the solenoid coil 71 by an electromagnetic force generated by the solenoid coil 71. The solenoid coil 71 and the plunger 72 form a hydraulic valve 70.

An actuator unit 80 for ABS control is mounted on a lower end surface of the side wall 31 of the equipment accommodating portion 30 so as to close an opening of the equipment accommodating portion 30. This mounting is performed, for example, by bolt-fastening using a plurality of bolt fastening holes (not illustrated) provided in the side wall 31.

Although not illustrated, the actuator unit 80 has a built-in valve seat portion of a plurality of hydraulic valves 70, a pump for pumping hydraulic oil stored in a reservoir, and the like and a motor 90 for driving a pump is mounted on a lower surface of the actuator unit 80.

A lower end of the plunger 72 accommodated in each solenoid coil 71 is inserted into the valve seat portion of the hydraulic valve 70 in the actuator unit 80. By controlling an up-down position of the plunger 72 by an electromagnetic force generated by each solenoid coil 71, opening and closing of the corresponding hydraulic valve 70 is controlled, in such a manner that the well-known ABS control is executed.

To briefly describe ABS control, when a slip ratio of a certain wheel exceeds a predetermined value, the hydraulic valve 70 corresponding to the wheel is controlled to reduce a braking hydraulic pressure corresponding to the wheel from a hydraulic pressure corresponding to a brake pedal depression force generated by a master cylinder of a vehicle. As a result, the slip ratio of the wheel is adjusted so as to change within the predetermined value. The hydraulic oil returned to the reservoir when the braking hydraulic pressure is reduced is pumped by a pump driven by the motor 90 and returned to the master cylinder of the vehicle.

Figure 5:
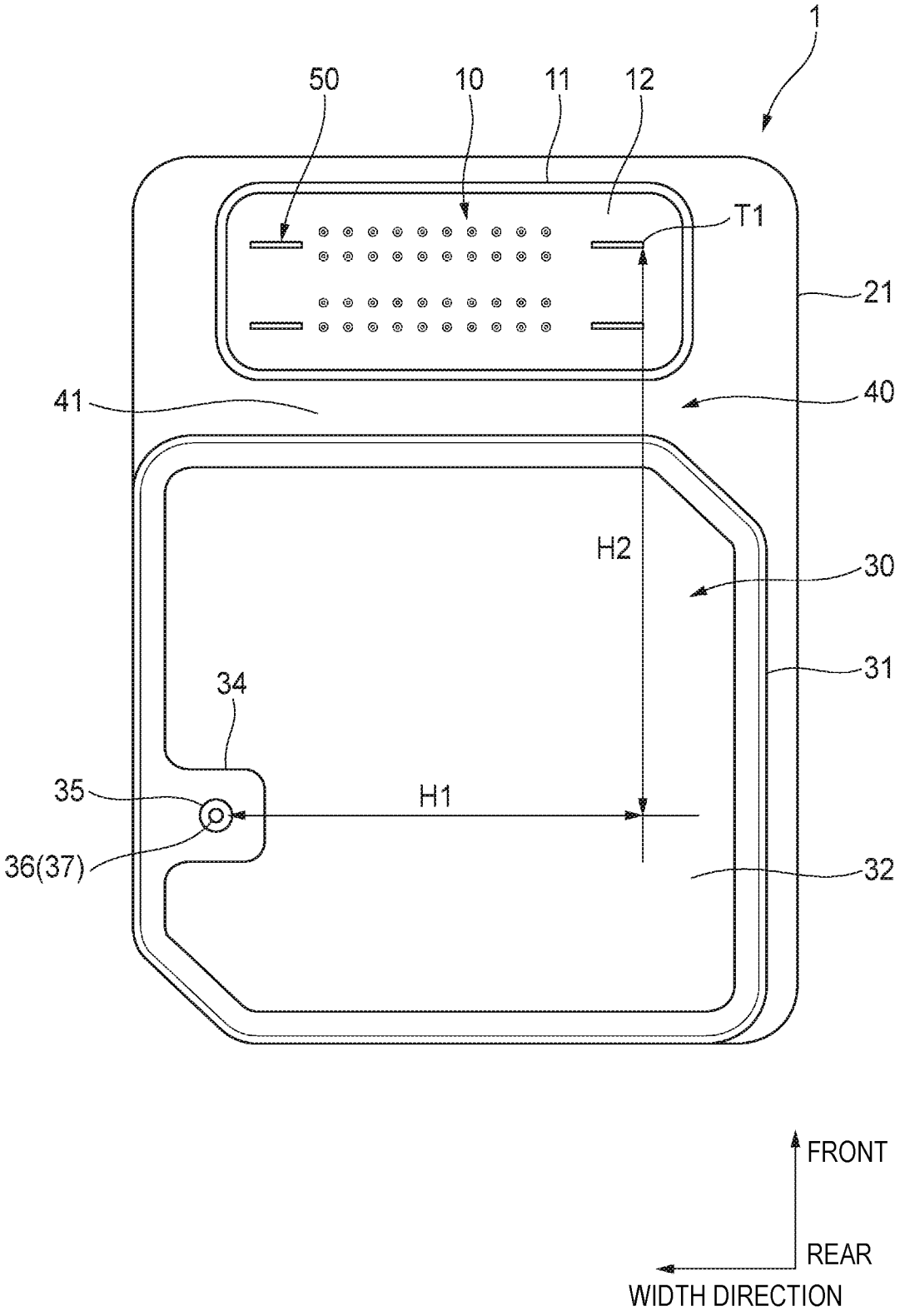
FIG. 5 is a bottom view of the resin molded product illustrated in FIG. 1 in a single state.

As illustrated in FIGS. 4 and 5, the equipment accommodating portion 30 is integrally formed with a protruding portion 34 which protrudes inward from a part of the side wall 31 in a circumferential direction and is continuous with the inner wall 32. A cylindrical boss portion 35 protruding downward is integrally formed on a lower end surface of the protruding portion 34. The boss portion 35 is used for alignment with the actuator unit 80 mounted on the equipment accommodating portion 30 so as to close an opening of the equipment accommodating portion 30. That is, a recess (not illustrated) corresponding to the boss portion 35 is formed on an upper end surface of the actuator unit 80, and by fitting the boss portion 35 and the recess, the equipment accommodating portion 30 and the actuator unit 80 are aligned with each other.

The boss portion 35 is formed with a through hole 36 which collectively penetrates the boss portion 35, the protruding portion 34 located above the boss portion 35, and the inner wall 32 (inner wall 22, base plate 40) in the up-down direction. That is, the through hole 36 has an opening 37 (see FIGS. 4 and 5) which opens in a protruding end surface (lower end surface) of the boss portion 35 and an opening 38 (see FIG. 6) which opens in an upper end surface of the inner wall 22.

In the resin molded product 1, the boss portion 35 is used as a reference in the dimensional inspection of the resin molded product 1. In this case, by using the through hole 36 formed in the boss portion 35, even in the dimensional inspection from either the lower side or the upper side of the resin molded product 1, the boss portion 35 can be used as a common reference in the dimensional inspection.

More specifically, for example, as a dimensional inspection, as illustrated in FIG. 5, it is assumed that, from the lower side of the resin molded product 1, a width direction dimension H1 and a front-rear direction dimension H2 between a part T1 of the terminal 50 of the connector portion 10 protruding downward from the lower end surface of the inner wall 12 of the connector portion 10 and the boss portion 35 are measured. In this case, both the part T1 of the terminal 50 and the opening 37 of the boss portion 35 are visible from the lower side of the resin molded product 1. Therefore, from the lower side of the resin molded product 1, the width direction dimension and the front-rear direction dimension between the part T1 of the terminal 50 and the opening 37 of the through hole 36 can be directly measured as the width direction dimension H1 and the front-rear direction dimension H2.

Figure 6:
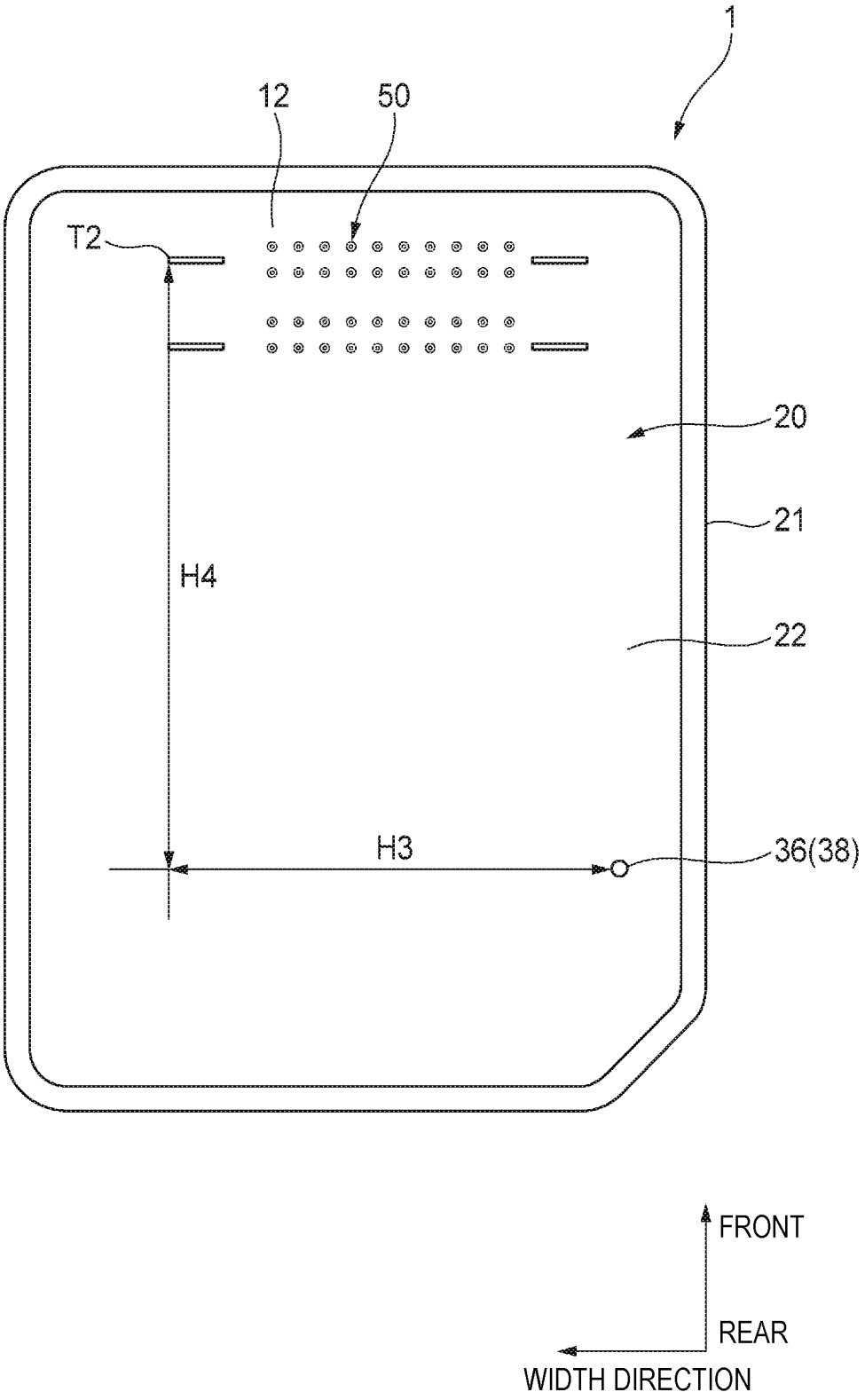
FIG. 6 is a top view of the resin molded product illustrated in FIG. 1 in a single state.

Similarly, for example, as a dimensional inspection, as illustrated in FIG. 6, it is assumed that, from the upper side of the resin molded product 1, a width direction dimension H3 and a front-rear direction dimension H4 between the part T2 of the terminal 50 of the connector portion 10 protruding upward from the upper end surface of the inner wall 12 (inner wall 22 of substrate accommodating portion 20) of the connector portion 10 and the boss portion 35 are measured. In this case, both the part T2 of the terminal 50 and the opening 38 of the boss portion 35 are visible from the upper side of the resin molded product 1. Therefore, from the upper side of the resin molded product 1, the width direction dimension and the front-rear direction dimension between the part T2 of the terminal 50 and the opening 38 of the through hole 36 can be directly measured as the width direction dimension H3 and the front-rear direction dimension H4. In this way, by using the openings 37 and 38 of the through hole 36, the boss portion 35 can be shared as a reference for the dimensional inspection even in the dimensional inspection from either the lower side or the upper side of the resin molded product 1.

Operation and Effect

In the resin molded product 1 according to the embodiment, the boss portion 35 used for alignment with the mating member (actuator unit 80) is provided on the lower surface of the base plate 40 (inner wall 32) and the boss portion 35 is formed with the through hole 36 which penetrates the boss portion 35 in the up-down direction and opens on both surfaces of the base plate 40. Therefore, the boss portion 35 (through hole 36) can be shared as a reference in the dimensional inspection even in the dimensional inspection from either the lower side or the upper side of the base plate 40. Specifically, from the lower side of the base plate 40, as a relative position from the boss portion 35 of the assembly location T1 (see FIG. 5) provided on the lower surface of the base plate 40, it is possible to directly measure the relative position of the assembly location T1 from the opening 37 on the lower side of the through hole 36. Similarly, from the upper side of the base plate 40, as a relative position from the boss portion 35 of the assembly location T2 (see FIG. 6) provided on the upper surface of the base plate 40, it is possible to directly measure the relative position of the assembly location T2 from the opening 38 on the upper side of the through hole 36. In this way, in the dimensional inspection from either the lower side or the upper side of the base plate 40, the relative positions of the assembly locations T1 and T2 from the boss portion 35 can be directly measured by using the openings 37 and 38 of the through hole 36. Therefore, the accuracy of the dimensional inspection is high and the man-hours required for the dimensional measurement are small as compared with the resin molded product of the related art.

Further, as another effect, by forming the through hole 36 in the boss portion 35, it is possible to suppress deformation such as warpage due to molding shrinkage in the boss portion 35. As a result, the accuracy of alignment with the mating member (actuator unit 80), which is an original function of the boss portion 35, is improved. Further, by forming the through hole 36 in the boss portion 35, the total mass of the resin molded product 1 can be reduced, and thus the weight of the resin molded product 1 can be reduced and the manufacturing cost can be reduced.

Further, in the resin molded product 1 according to the embodiment, the boss portion 35 in which the through hole 36 is formed has a shape extending in a columnar shape in the up-down direction. Therefore, a wall thickness of the boss portion 35 can be designed to be thinner than that in the case where the boss portion 35 in which the through hole 36 is formed has a shape different from the columnar shape. As a result, deformation such as warpage due to molding shrinkage in the boss portion 35 can be further suppressed, and thus the accuracy of alignment with the mating member (actuator unit 80), which is the original function of the boss portion 35, is further improved.

Further, in the resin molded product 1 according to the embodiment, the terminal 50 is provided so as to protrude upward from the upper surface of the base plate 40. Therefore, from the upper side of the resin molded product 1, it is possible to directly measure the relative position of the terminal 50 from the opening 38 on the upper side of the through hole 36 as a relative position of the terminal 50 protruding upward from the upper surface of the base plate 40 from the boss portion 35. Therefore, the accuracy of the dimensional inspection for the terminal 50 protruding upward from the upper surface of the base plate 40 is improved, and thus the reliability of the electrical connection between the terminal 50 and a contact point (through hole) on the circuit board 60 side connected to the terminal 50 is improved.

Other Aspects

The invention is not limited to each of the embodiments described above and various modifications can be adopted within the scope of the invention. For example, the invention is not limited to the embodiment described above and can be appropriately modified, improved, and the like. In addition, the material, shape, size, number, arrangement location, and the like of each component in the embodiment described above are arbitrary and are not limited as long as the invention can be achieved.

In the embodiment described above, as the "reference portion" of the invention, the boss portion 35 which protrudes downward from the lower end surface of the protruding portion 34 which protrudes inward of the equipment accommodating portion 30 from a part of the side wall 31 in the circumferential direction is adopted. On the other hand, the boss portion 35 may be omitted and the protruding portion 34 itself protruding inward of the equipment accommodating portion 30 from a part of the side wall 31 in the circumferential direction may be adopted as the "reference portion" of the invention. In this case, the through hole 36 has an opening which opens on the lower end surface of the protruding portion 34 and the opening 38 (see FIG. 6) which opens on the upper end surface of the inner wall 32.

Here, the features of the above-described embodiment of the resin molded product according to the invention are briefly summarized and listed below in [1] to [3].

[1]

A resin molded product (1) which includes a plate portion (40) having a plate-like shape and having assembly locations (10, 20, 30) in which a mating member (60, 71, 80) is assembled on both surfaces of the plate portion in a plate thickness direction, a reference portion (35) provided on one surface of the plate portion (40) and used for alignment with the mating member (80), and a through hole (36) which penetrates the reference portion (35) in the plate thickness direction and opens on both surfaces of the plate portion (40).

[2]

The resin molded product (1) according to [1], wherein the reference portion (35) has a columnar shape extending in the plate thickness direction, and the through hole (36) opens at an extending end of the reference portion (35) and extends in the plate thickness direction to open on the other surface of the plate portion (40).

[3]

The resin molded product (1) according to [1], wherein the plate portion (40) further includes a terminal (50) provided so as to extend in the plate thickness direction at the assembly location (20) on the other surface.

In the resin molded product having the configuration of [1], the reference portion used for alignment with the mating member is provided on one surface of the plate portion. The through hole is formed in this reference portion, which penetrates the reference portion in the plate thickness direction and opens on both surfaces of the plate portion. Therefore, the reference portion (through hole thereof) can be used as a reference in the dimensional inspection even in the dimensional inspection on either one surface or the other surface of the plate portion. Specifically, as a relative position from the reference portion of the assembly location provided on one surface of the plate portion, the relative position can be directly measured with reference to the opening on one side of the through hole of the assembly location. Similarly, as a relative position from the reference portion of the assembly location provided on the other surface of the plate portion, the relative position can be directly measured with reference to the opening on the other side of the through hole of the assembly location. In this way, even in the dimensional inspection on either one side or the other side of the plate portion, the relative position of the assembly location from a common reference point (that is, the reference portion) can be measured by using the opening of the through hole. Therefore, the resin molded product of this configuration can improve the accuracy of dimensional inspection and reduce the man-hours required for dimensional measurement.

Further, as another effect, by forming a through hole in the reference portion, deformation such as warpage due to molding shrinkage in the reference portion can be suppressed. As a result, the accuracy of alignment with the mating member, which is the original function of the reference portion, is improved. Furthermore, by forming the through hole in the reference portion, it is possible to reduce the weight of the resin molded product and the manufacturing cost.

In the resin molded product having the configuration of [2], the reference portion in which the through hole is formed has a shape (so-called boss-like shape) extending in a columnar shape in the plate thickness direction. Therefore, a wall thickness of the reference portion can be designed to be thinner than that in the case where the reference portion has other shapes. As a result, deformation such as warpage due to molding shrinkage in the reference portion can be further suppressed and the accuracy of alignment with the mating member, which is the original function of the reference portion, is further improved.

In the resin molded product having the configuration of [3], the terminal extending in the plate thickness direction is provided at the assembly location on the other surface of the plate portion. Therefore, the terminals can be arranged in the plate portion with high accuracy, and thus the reliability of the electrical connection at the contact point between the terminal and a mating terminal or the like can be improved. In this way, with the resin molded product of this configuration, high-precision dimensional inspection can be performed with a small number of man-hours even when a component which requires particularly accurate placement is provided in the plate portion.

As described above, according to the present invention, it is possible to provide a resin molded product which can improve the accuracy of dimensional inspection and reduce the man-hours required for dimensional measurement.

What is claimed is:

1. A resin molded product comprising:

a plate portion having a plate-like shape and having assembly locations in which a mating member is assembled on both surfaces of the plate portion in a plate thickness direction;

a reference portion provided on one surface of the plate portion and used for alignment with the mating member; and a through hole which penetrates the reference portion in the plate thickness direction and opens on the both surfaces of the plate portion, wherein an equipment accommodating portion is provided on the one surface of the plate portion, and includes a side wall formed with a rectangular tubular frame body protruding downward, the equipment accommodating portion is integrally formed with a protruding portion which protrudes inward from a part of the side wall in a circumferential direction, and the protruding portion is used as the reference portion.

2. The resin molded product according to claim 1, wherein the reference portion has a columnar shape extending in the plate thickness direction, and the through hole opens at an extending end of the reference portion and extends in the plate thickness direction to open on the other surface of the plate portion.

3. The resin molded product according to claim 1, wherein the plate portion further includes a terminal provided so as to extend in the plate thickness direction at the assembly location on the other surface.

* * * * *